313-414 SR
2/3/87 XR 4,641,058

United States Patent [19]
Koshigoe et al.

[11] Patent Number: 4,641,058
[45] Date of Patent: Feb. 3, 1987

[54] ELECTRON GUN

[75] Inventors: Shinpei Koshigoe; Takeshi Fujiwara, both of Fukaya, Japan

[73] Assignee: Tokyo Shibaura Denki Kabushiki Kaisha, Kawasaki, Japan

[21] Appl. No.: 815,320

[22] Filed: Jan. 3, 1986

Related U.S. Application Data

[63] Continuation of Ser. No. 508,534, Jun. 28, 1983, abandoned.

[30] Foreign Application Priority Data

Jul. 5, 1982 [JP] Japan ..... 57-115447

[51] Int. Cl.[4] ..... H01J 29/46; H01J 29/50
[52] U.S. Cl. ..... 313/449; 313/414
[58] Field of Search ..... 313/414, 448, 449

[56] References Cited

U.S. PATENT DOCUMENTS

| | | | |
|---|---|---|---|
| 3,919,583 | 11/1975 | Haske et al. | 313/448 |
| 4,143,293 | 3/1979 | Hosokoshi et al. | 313/414 X |
| 4,251,747 | 2/1981 | Burdick | 313/414 |
| 4,322,655 | 3/1982 | Takenaka et al. | 313/449 |
| 4,334,169 | 6/1982 | Takenaka et al. | 313/414 |
| 4,481,003 | 11/1984 | Yabe et al. | 445/49 |

FOREIGN PATENT DOCUMENTS

| | | | |
|---|---|---|---|
| 55-136442 | 10/1980 | Japan . | |
| 57-84554 | 5/1982 | Japan | 313/414 |
| 57-103244 | 6/1982 | Japan | 313/414 |
| 58-59534 | 4/1983 | Japan | 313/414 |
| 161916 | 10/1979 | Netherlands | 313/414 |

*Primary Examiner*—Kenneth M. Schor
*Attorney, Agent, or Firm*—Cushman, Darby & Cushman

[57] ABSTRACT

An electron gun is proposed which has a cathode for generating an electron beam and at least three grids, each having an opening. A pre-focusing electron lens and a main focusing electron lens are formed between the grids in the order named from the cathode to the grids. The pre-focusing lens constitutes a first asymmetric electron lens. The main focusing electron lens constitutes a second asymmetric electron lens. The first and second asymmetric electron lenses have focusing actions whose relatively stronger components are effected along directions substantially perpendicular to each other.

12 Claims, 18 Drawing Figures

ELECTRON GUN

This is a continuation of application Ser. No. 508,534, filed June 28, 1983, which was abandoned upon the filing hereof.

BACKGROUND OF THE INVENTION

The present invention relates to an electron gun and, more particularly, to an electron gun for a color picture tube.

In general, a color picture tube comprises a glass envelope 11, an electron gun 12 sealed within the glass envelope 11, a deflection system 14 disposed outside the glass envelope 11, a shadow mask 15 disposed in the glass envelope 11 and having a plurality of apertures, and a phosphor screen 16 formed on the inner surface of the glass substrate 11 and opposing the shadow mask, as shown in FIG. 1. A plurality of electron beams (e.g., three electron beams) emitted from the electron gun 12 within the color picture tube are deflected by the deflection system 14. The deflected electron beams pass through the apertures of the shadow mask 15 and are incident on the phosphor screen 16, thereby forming a color image on the screen.

An "in-line type" electron gun, wherein three electron guns are aligned in a line, is generally used as the electron gun 12.

A self convergence deflection system is generally used as the deflection system 14, wherein an inhomogeneous magnetic field which has a strong pincushion-like vertical deflection magnetic field and a strong barrel-like horizontal deflection magnetic field may be formed to converge the three electron beams at the peripheral portion within the screen. When the electron beam passes through such a deflection magnetic field, the electron beam is subject to a distortion called deflection defocusing under the influence of the deflection magnetic field. As a result, at the peripheral portion within the screen, the shape of the electron beam spot is greatly distorted, as shown in FIG. 2. In other words, the beam spots at edge portions 21 along the horizontal axis become horizontally elongated to have elliptical shapes. The beam spots at four corners corresponding to edge portions 22 along the diagonal axes are formed as combinations of horizontally elongated spots 23 and vertically elongated halo portions 24, respectively. For this reason, resolution is degraded at the peripheral portion of the screen, and uniform focusing is impaired. The uniformity of focusing is degraded when a deflection angle of the picture tube is increased to within a range between 100° and 110°. This nonuniform focusing cannot be neglected and presents a problem.

The typical structure of a conventional bi-potential type electron gun will be described with reference to FIG. 3. The bi-potential type electron gun comprises a cathode 30, a first grid 31, a second grid 32, a third grid 33, and a fourth grid 34 which are aligned along a central axis 35. Among these elements, the cathode 30, the first grid 31 and the second grid 32 constitute a triode. The third grid 33 and the fourth grid 34 form a main electron lens 36, thereby constituting a main lens part. For example, voltages of about 150 V, 600 V, 5 kV, and 25 kV are applied to the cathode 30, the second grid 32, the third grid 33 and the fourth grid 34, respectively. The first grid 31 is grounded. The triode constituted by the cathode 30, the first grid 31 and the second grid 32 emits electron beams and forms an object for the main electron lens 36 constituted by the third grid 33 and the fourth grid 34. The electron beam is focused by the main electron lens 36 to form an electron beam spot on the phosphor screen. The second grid 32 and the third grid 33 form a pre-focusing lens 37. The pre-focusing lens 37 focuses the electron beam so as to allow the beam to be incident on the main electron lens 36.

In the electron lens as described above, it has been proposed to change the shape of the beam spot by making the shape of the openings of the grids asymmetric. For example, in U.S. Pat. No. 3,919,583, an electron gun is disclosed wherein first and second grids have vertically elongated openings, respectively. In particular, in this electron gun, the grids which constitute the triode alone have asymmetric openings. By using such first and second grids, the beam spot on the screen is extremely elongated along the vertical axis. It should be noted that the first and second grids are employed in a beam index color cathode-ray tube. This is because the beam index color cathode-ray tube generally requires an extremely vertically elongated beam spot due to its mode of operation.

Another electron gun which resembles the electron gun described above is disclosed in U.S. Pat. No. 4,322,655. In this example, a first grid has a vertically elongated opening, and the grids of a main lens part respectively have asymmetric openings. The first grid and the grids of the main lens part in this prior art example are also used in a beam index color cathode-ray tube so as to obtain a vertically elongated beam spot.

In still another electron gun disclosed in U.S. Pat. No. 4,143,293, a first grid has a vertically elongated opening, and a sub electrode is disposed between second and third grids. The sub electrode has an asymmetric opening. The electron gun of this prior art example is used to form a vertically elongated beam spot at the central portion of the screen. However, the necessity of providing the sub electrode results in inconvenience.

In still another electron gun disclosed in Japanese Patent Disclosure No. 56-149755, cylindrical edges of openings of third and fourth grids are set at a predetermined length so as to form a vertically elongated beam spot at the central portion of the screen. In addition to these examples, in an electron gun described in U.S. Pat. No. 4,242,613, a first grid has an opening portion which comprises openings formed in a criss-cross manner at one side of the first grid which opposes a cathode and at the other side thereof which opposes a second grid. According to this construction, horizontal focusing of the electron beam differs from vertical focusing thereof by a given magnitude, thereby decreasing deflection defocusing.

In the conventional electron guns described above, deflection defocusing can be decreased by forming a vertically elongated beam spot at the central portion of the screen. However, resolution at the central portion of the screen is thereby degraded. More particularly, since the beam spot has a vertically elongated shape, the width of the horizontal line on the screen is increased when the electron beam is deflected along the horizontal axis.

In addition to these conventional electron guns, an electron gun is described in Japanese Patent Disclosure No. 54-150961. In this electron gun, two sub electrodes are added to perform dynamic focusing. However, a separate power supply is required, resulting in a large and complex construction.

SUMMARY OF THE INVENTION

It is an object of the present invention to provide an electron gun for a cathode-ray tube wherein resolution at a peripheral portion of a screen is improved by a simple system without degrading resolution at a central portion thereof.

In order to achieve the above object of the present invention, there is provided an electron gun comprising: a cathode for generating an electron beam; and at least three grids each having an opening through which the electron beam passes. A pre-focusing electron lens and a main focusing electron lens are formed between said grids in this order when viewed from said cathode to said grids. The pre-focusing lens comprises a first asymmetric electron lens, and the main focusing electron lens comprises a second asymmetric electron lens. The direction along which the focusing action of the first asymmetric electron lens is relatively strong is substantially perpendicular to the direction along which the focusing action of the second asymmetric electron lens is relatively strong.

In the present specification, the term "asymmetric" means that rotation symmetry through any angle cannot be achieved (i.e., the term indicates a graphic figure which excludes a circle). Therefore, the term "asymmetric electron lens" means a lens in which the focusing action upon the electron beam cannot be equally effected in all directions (i.e., the focusing action is relatively strong in a particular direction).

More specifically, the first asymmetric electron lens has an overall focusing action which is relatively strong in the vertical direction. Similarly, the second asymmetric electron lens has an overall focusing action which is relatively strong in the horizontal direction.

According to the present invention, the resolution of the screen can be uniform over the entire area thereof and can be improved by a combination of the pre-focusing electron lens and the main electron lens.

DETAILED DESCRIPTION OF THE PREFERRED EMBODIMENTS

The present invention will be described in detail with reference to the accompanying drawings.

Figure 4:
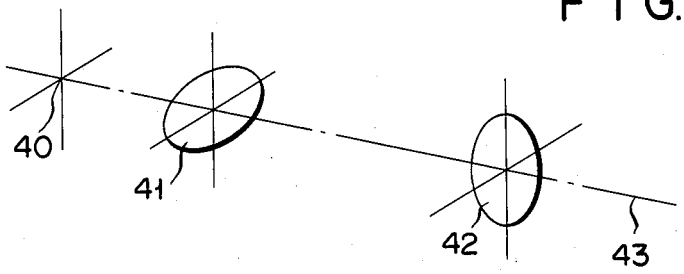
FIG. 4 is a representation for explaining the principle of first and second asymmetric electron lenses in an electron gun according to the present invention.

FIG. 4 schematically shows the imaginary shapes of a pre-focusing electron lens and a main focusing electron lens. Referring to FIG. 4, an object 40, a first asymmetric electron lens 41 as the pre-focusing electron lens, and a second asymmetric electron lens 42 as the main focusing electron lens are aligned on a central axis 43. The focusing actions of the first and second asymmetric electron lenses 41 and 42 act strongly on the electron beam in directions substantially perpendicular to each other.

The focusing actions of the first and second asymmetric electron lenses 41 and 42 will now be considered independently of each other.

Figure 5:
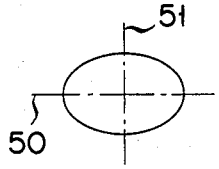
FIGS. 5 and 6 are representations showing the shapes of the beam spots obtained by the focusing actions of the first and second asymmetric electron lenses shown in FIG. 4, respectively.
Figure 6:
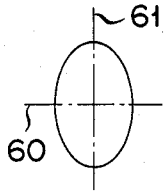

FIG. 5 shows a shape of the electron beam spot obtained only by the focusing action of the first asymmetric electron lens 41. The electron beam spot is elliptical, elongated along the horizontal axis. In other words, the first asymmetric electron lens 41 has a focusing action which is stronger along a vertical axis 51 than along a horizontal axis 50. FIG. 6 shows a shape of the electron beam spot obtained only by the focusing action of the second asymmetric electron lens 42. The electron beam spot is elliptical, elongated along the vertical axis. In other words, the second asymmetric electron lens 42 has a focusing action which is stronger along a horizontal axis 60 than along a vertical axis 61.

Figure 7A:
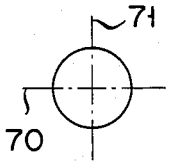
FIGS. 7A and 7B are representations showing the shapes of beam spots obtained by the electron lens shown in FIG. 4, respectively.
Figure 7B:
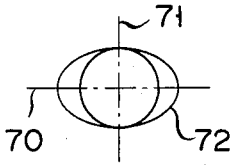

The electron beam spot obtained by the focusing actions of both asymmetric electron lenses 41 and 42 is substantially circular, as shown in FIG. 7A. In this case, when a focusing voltage is lowered to increase the focusing action, a halo portion 72 is formed along the horizontal axis 70, as shown in FIG. 7B. Since the focusing action of the first asymmetric electron lens 41 is strong along the vertical axis, the position on the vertical axis, at which the electron beam is incident on the second asymmetric electron lens 42, comes closer to the central axis than the horizontal-axis position at which the electron beam is incident thereon. As a result, the electron beam is subject to a small spherical aberration under the influence of the second asymmetric electron lens 42 along the vertical axis. Therefore, the total spherical aberration acting on the electron beam due to the first and second asymmetric electron lenses 41 and 42 is decreased.

Figure 1:
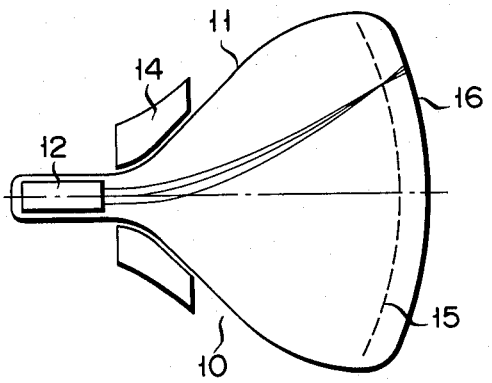
FIG. 1 (PRIOR ART)
FIG. 1 is a schematic view showing the overall construction of a conventional color picture tube.
Figure 2:
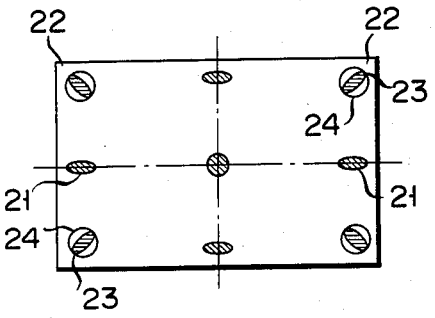
FIG. 2 (PRIOR ART)
FIG. 2 is a representation showing the shapes of beam spots on the screen of the conventional color picture tube.
Figure 3:
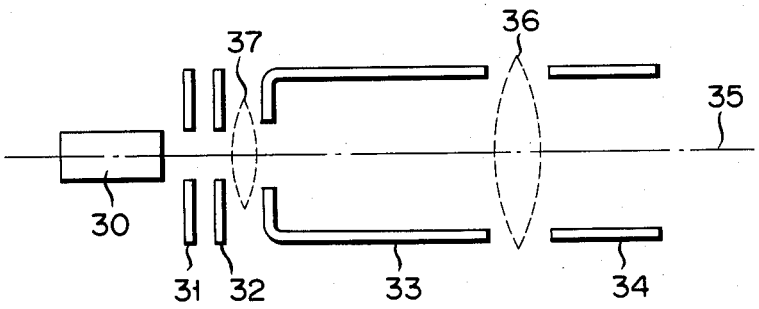
FIG. 3 (PRIOR ART)
FIG. 3 is a schematic sectional view showing the overall construction of a conventional bi-potential type electron gun.

The electron lens system shown in FIG. 4 may be practically applied to the bi-potential type electron gun shown in FIG. 3. In this case, the pre-focusing electron lens 37 constituted by the second grid 32 and the third grid 33 shown in FIG. 3 corresponds to the first asymmetric electron lens 41 in FIG. 4. Similarly, the main focusing electron lens 36 constituted by the third and fourth grids 33 and 34 in FIG. 3 corresponds to the second asymmetric electron lens 42.

According to the present invention, the first asymmetric electron lens is not formed in the triode but in the pre-focusing lens part for the following reason. Since the triode is a part which forms the object on the main focusing electron lens, the object formed by the triode becomes asymmetric when the asymmetric electron lens is formed in the triode. When the object itself becomes asymmetric, it is impossible to compensate for the asymmetric object in the focusing lens system. Even if the asymmetric object can be compensated for, this entails an astigmatism, which is impractical. In various types of conventional examples, the opening of the first grid has an asymmetric shape so as to obtain a vertically elongated beam spot. For this reason, in many conventional electron guns, the asymmetric lens is formed in the triode. As a result, the sectional shape of the asymmetric electron beam formed by the triode part may not be compensated for in the focusing lens system, and the electron beam is focused on the screen.

On the other hand, the pre-focusing electron lens has the function of pre-focusing the electron beam as the object formed by the triode. Therefore, the pre-focusing electron lens does not function to change the properties of the electron beam itself as the object. In general, the pre-focusing electron lens acts to focus only the remote electron beam spaced apart from the central axis. This remote electron beam corresponds to the spherical aberration and is focused by the pre-focusing electron lens. The asymmetric sectional shape or profile of the remote electron beam can then be compensated for by the main focusing electron lens. Therefore, only when the pre-focusing and main focusing lenses (as the asymmetric electron lenses) are combined, can an electron beam spot which has a desired shape, i.e., a substantially circular shape, be obtained. As described in Japanese Patent Disclosure No. 55-136442, the first grid has a horizontally elongated opening, and the fourth grid has a vertically elongated opening. Under this condition, an asymmetric electron lens is formed in the triode. As a result, it is very difficult to make a beam spot on the screen close to a substantially circular without generating an astigmatism.

The second and/or third grid for forming the first asymmetric electron lens will now be described.

Figure 8:
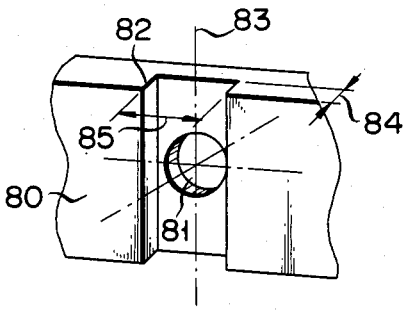
FIG. 8 is a schematic view showing the main part of a third grid of an electron gun according to a first embodiment of the present invention.
Figure 9:
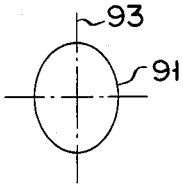
FIG. 9 is a representation showing the shape of an opening of the third grid shown in FIG. 8.

FIG. 8 is a perspective view showing part of a third grid 80 corresponding to the third grid 33 of the electron gun shown in FIG. 3. A vertically extending groove 82 is formed on the side of the third grid 80 which opposes a second grid (not shown). A substantially circular opening 81 is centrally formed in the bottom surface of the groove 82 so as to penetrate therethrough. The diameter of the opening 81 is as large as 1.10 mm. The groove 82 has a depth 84 of 0.26 mm and a width 85 of 1.20 mm. The focusing power of the first asymmetric electron lens formed by the second grid and the third grid 80 may be arbitrarily set by properly determining the depth 84 and the width 85 of the groove 82 and the shape of the opening 81. In order to further increase the focusing power of the first asymmetric electron lens, the depth 84 of the groove 82 may be increased, and the opening 81 may have an elliptical shape 91 extending along a vertical axis 93 as shown in FIG. 9.

Figure 10:
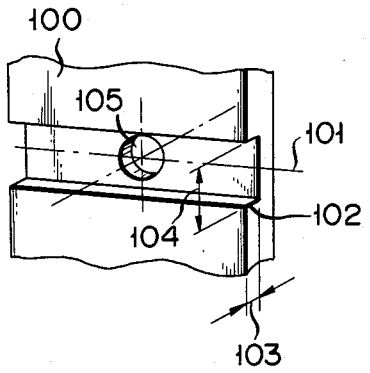
FIG. 10 is a schematic view showing the main part of a second grid of the electron gun according to the first embodiment of the present invention.

The second grid is also formed in a predetermined shape to form the first asymmetric electron lens, as shown in FIG. 10. FIG. 10 is a perspective view showing part of a second grid 100 corresponding to the second grid 32 of the electron gun shown in FIG. 3. A horizontal groove 102 along a horizontal axis 101 is formed on the side of the second grid 100 which opposes a third grid (not shown). An opening 105 is centrally formed in the bottom surface of the groove 102. The diameter of the opening 102 is 0.66 mm. The groove 102 has a depth 103 of 0.2 mm and a width 104 of 1.0 mm.

By combining the third grid 80 (FIG. 8) and the second grid 100 (FIG. 10), a first asymmetric electron lens having a high focusing power can be obtained.

A third and/or fourth grid for obtaining a second asymmetric electron lens will be described hereinafter.

Figure 11:
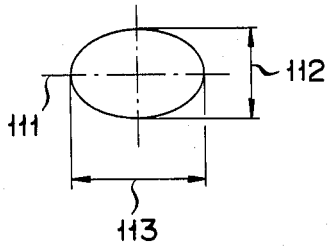
FIGS. 11 and 12 are representations showing the shapes of openings of fourth and third grids, respectively, of the electron gun according to the first embodiment of the present invention.
Figure 12:
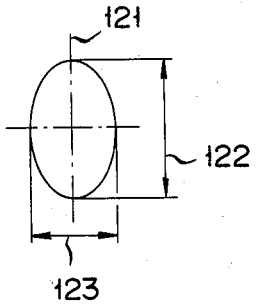

FIG. 11 shows the shape of an opening of a fourth grid corresponding to the fourth grid 34 of the electron gun shown in FIG. 3. The opening has an elliptical shape with its major axis 113 extending along a horizontal axis 111. A minor axis 112 of the ellipse has a length falling within a range between 3.85 mm and 3.88 mm, and the major axis 113 thereof has a length of 3.90 mm. In this manner, by a combination of the third grid and the fourth grid having elliptical openings, the second asymmetric electron lens of the present invention can be formed. Alternatively, when a grid having a circular opening is used as the fourth grid, and a grid having an elliptical opening elongated along a vertical axis 121 shown in FIG. 12 is used as the third grid, the second asymmetric electron lens may be obtained. In this case, a minor axis 123 and a major axis 122 of the ellipse are substantially the same as those of the ellipse shown in FIG. 11. In addition to this modification, by a combination of the fourth grid having the opening shown in FIG. 11 and the third grid having the opening shown in FIG. 12, a second asymmetric electron lens having a high focusing power can be formed. When the electron beam is pre-focused by the first asymmetric electron lens, the vertical-axis position of the electron beam incident on the second asymmetric electron lens is closer to the central axis than the horizontal-axis position thereof. Therefore, even if the focusing power of the second asymmetric electron lens is not higher than that of the first asymmetric electron lens, a strong overall focusing action can be effected. Even if the minor axis is only slightly shorter than the major axis, an effective focusing action is sufficiently applied to the electron beam. However, it is natural for the focusing action to be increased when the ratio of the major axis to the minor axis is increased.

Figure 13:
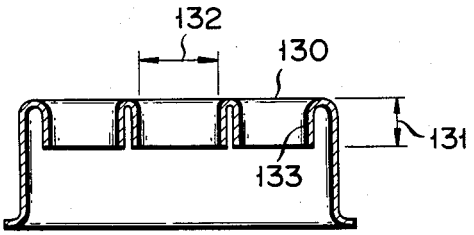
FIGS. 13 and 14 are a sectional view and a perspective view, respectively, of grids of an electron gun according to a second embodiment of the present invention.
Figure 14:
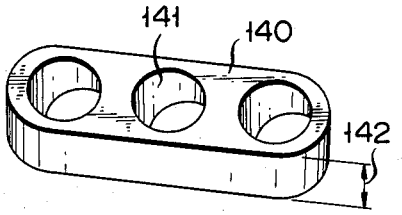

As shown in FIG. 13, the second asymmetric electron lens may also be formed by properly determining the ratio of a length 131 of cylindrical edges 133 of three openings to a opening diameter 132 of a unitized grid 130. In general, when the length 131 of the cylindrical edge 133 of the opening of at least one grid 130 of a pair of grids is more than one-half of the diameter 132 of the openings thereof, a substantially symmetric lens can be obtained. However, when the length 131 is less than $\frac{1}{2}$ the diameter 132 (e.g., the cylindrical edge 133 has a length of about 1.0 mm and the opening has a diameter of 3.90 mm), an asymmetric electron lens can be formed. A unitized grid 140 (FIG. 14) having openings 141 formed by punch forming may be used in place of the unitized grid 130 (FIG. 13) having openings formed by press forming. In this case, a depth 142 of the openings 141 (i.e., the thickness of the unitized grid 140) is set to be less than ½ the diameter thereof. Under this condition, when the openings 141 of the unitized grid 140 as the fourth grid have a diameter of 4.52 mm and a depth 142 of about 1.5 mm, a desired second asymmetric lens can be obtained. The openings 141 of the unitized grid 140 shown in FIG. 14 may be formed to have a larger diameter than those of the unitized grid 130 shown in FIG. 13. Therefore, the unitized grid 140 in FIG. 14 is suitable for forming a large electron lens.

Figure 15:
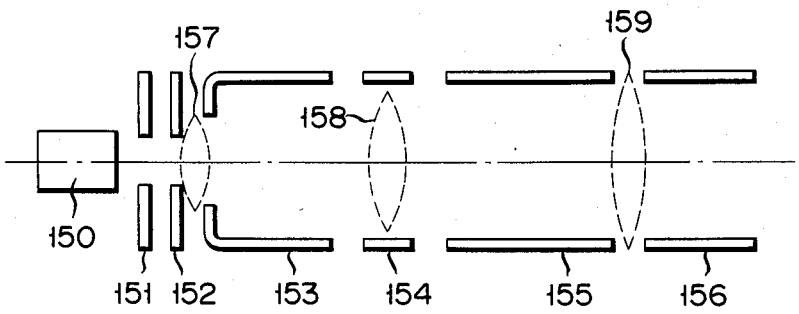
FIG. 15 is a schematic sectional view showing the basic construction of a composite lens type electron gun.

A case has been described wherein the present invention is applied to a bi-potential electron gun. The present invention may also be applied to a composite lens type electron gun, as shown in FIG. 15. The composite lens type electron gun comprises a cathode 150, a first grid 151, a second grid 152, a third grid 153, a fourth grid 154, a fifth grid 155 and a sixth grid 156. Typically, voltages of 150 V, 600 V, 7 kV, 600 V, 7 kV, and 25 kV are applied to the cathode 150, the second grid 152, the third grid 153, the fourth grid 154, the fifth grid 155 and the sixth grid 156, respectively. The first grid 151 is grounded. In this electron gun, the cathode 150, first grid 151 and second grid 152 constitute a triode. The second grid 152 and third grid 153 constitute a pre-focusing lens 157. The third grid 153, fourth grid 154 and fifth grid 155 constitute a sublens 158. The fifth grid 155 and sixth grid 156 constitute a main lens 159. In this case, the pre-focusing lens 157 serves as the first asymmetric lens, and the main lens 159 serves as the second asymmetric lens.

Figure 16A:
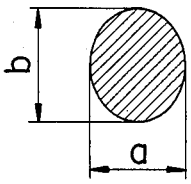
FIGS. 16A and 16B are representations showing beam spots formed by the electron gun of the present invention at the central and peripheral portions of the screen, respectively.
Figure 16B:
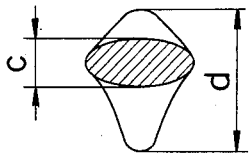

FIGS. 16A and 16B show the shapes of the beam spots obtained from the electron gun at the central and peripheral portions on the screen according to the present invention. The ratio of a minor axis b to a major axis a of the beam spot, b/a, and the ratio of a halo portion length d to a minor axis c of the beam spot, d/c, are the criteria for determining the degree of distortion of the shape of the beam spot. The distortion is decreased when these ratios come close to 1. When the ratios b/a and d/c of the electron gun applied to the bi-potential electron gun are measured, the following results are obtained.

| | b/a | d/c |
|---|---|---|
| Prior art | 1.35 | 2.7 |
| Present invention | 1.05 | 2.0 |

As may be apparent from the above table, the ratio b/a of the electron gun of the present invention is improved by about 22%, the ratio d/c thereof by about 26%, and the average value of the ratios b/a and d/c is improved by about 25%, as compared with the ratios of the conventional electron gun.

What is claimed is:

1. An electron gun arrangement, comprising:

a cathode for generating an electron beam; and first, second, third and fourth grids, in order of increasing distance from said cathode, the cathode, first grid and second grid constituting a triode, each grid having an opening therein through which said electron beam can pass, said second and third grids together functioning to provide a first asymmetrical electron lens having a focusing action that is stronger along a vertical direction than along a horizontal direction, said third and fourth grids together functioning to provide a second asymmetrical electron lens having a focusing action that is stronger along said horizontal direction than along said vertical direction.

2. An electron gun according to claim 1, wherein said second grid has a horizontally extending groove formed on a side thereof which opposes said third grid, said groove having a bottom surface through which an opening is centrally formed so as to pass the electron beam therethrough.

3. An electron gun according to claim 1, wherein said third grid has a vertically extending groove formed on a side thereof which opposes said second grid, said groove having a bottom surface through which an opening is centrally formed so as to pass the electron beam therethrough.

4. An electron gun according to claim 1, wherein said second grid has a horizontally extending groove formed on a side thereof which opposes said third grid, said horizontally extending groove having a bottom surface through which an opening is centrally formed so as to pass the electron beam therethrough, and said third grid has a vertically extending groove formed on a side thereof which opposes said second grid, said vertically extending groove having a bottom surface through which an opening is centrally formed so as to pass the electron beam therethrough.

5. An electron gun according to claim 1, wherein an opening of said third grid has a vertically elongated elliptical shape and/or said opening of said fourth grid has a horizontally elongated elliptical shape.

6. An electron gun according to claim 1, wherein an opening of said third grid and/or said fourth grid has a cylindrical edge, said cylindrical edge having a length less than ½ of a diameter of said opening of said third grid and/or said fourth grid.

7. An electron gun arrangement, comprising:

a cathode for generating an electron beam; and first, second, third, fourth, fifth and sixth grids, in order of increasing distance from said cathode, the cathode, first grid and second grid constituting a triode, each grid having an opening therein through which said electron beam can pass, said second and third grids together functioning to provide a first asymmetrical electron lens having a focusing action that is stronger along a vertical direction than along a horizontal direction, said fifth and sixth grids together functioning to provide a second asymmetrical electron lens having a focusing action that is stronger along said horizontal direction than along said vertical direction.

8. An electron gun according to claim 7, wherein said second grid has a horizontally extending groove formed on a side thereof which opposes said third grid, said groove having a bottom surface through which an opening is centrally formed so as to pass the electron beam therethrough.

9. An electron gun according to claim 7, wherein said third grid has a vertically extending groove formed on a side thereof which opposes said second grid, said groove having a bottom surface through which an opening is centrally formed so as to pass the electron beam therethrough.

10. An electron gun according to claim 7, wherein said second grid has a horizontally extending groove formed on a side thereof which opposes said third grid, said horizontally extending groove having a bottom surface through which an opening is centrally formed so as to pass the electron beam therethrough, and said third grid has a vertically extending groove formed on a side thereof which opposes said second grid, said vertically extending groove having a bottom surface through which an opening is centrally formed so as to pass the electron beam therethrough.

11. An electron gun according to claim 7, wherein an opening of said fifth grid has a vertically elongated elliptical shape and/or an opening of said sixth grid has a horizontally elongated elliptical shape.

12. An electron gun according to claim 7, wherein an opening of said fifth grid and/or said sixth grid has a cylindrical edge, said cylindrical edge having a length less than ½ of a diameter of said opening of said fifth grid and/or said sixth grid.

* * * * *